US009997318B2

(12) United States Patent
Schaper

(10) Patent No.: US 9,997,318 B2
(45) Date of Patent: Jun. 12, 2018

(54) RELAY WITH A CONTROLLER

(71) Applicant: Phoenix Contact GmbH Co. KG, Blomberg (DE)

(72) Inventor: Elmar Schaper, Lügde (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days. days.

(21) Appl. No.: 15/703,504

(22) Filed: Sep. 13, 2017

(65) Prior Publication Data

US 2018/0096809 A1 Apr. 5, 2018

(30) Foreign Application Priority Data

Sep. 14, 2016 (DE) ..... 10 2016 117 271

(51) Int. Cl.
*H01H 47/18* (2006.01)
*H01H 47/22* (2006.01)

(52) U.S. Cl.
CPC ..... *H01H 47/18* (2013.01); *H01H 47/22* (2013.01)

(58) Field of Classification Search
CPC ..... H01H 47/04; H01H 47/22; H01H 47/32
USPC ..... 361/78–80
See application file for complete search history.

(56) References Cited

U.S. PATENT DOCUMENTS 4,402,028 A * 8/1983 Udren ..... H02H 7/045 361/78
5,267,120 A * 11/1993 Graff ..... H01H 47/002 323/244
9,425,011 B2 * 8/2016 Creighton ..... H01H 9/56
2003/0169544 A1 * 9/2003 Langford ..... H02H 1/0015 361/42
2014/0268458 A1 * 9/2014 Luciani ..... H02H 3/10 361/86

FOREIGN PATENT DOCUMENTS

DE 10 2005 005 228 A1 8/2006
DE 10 2005 051 762 A1 5/2007

* cited by examiner

*Primary Examiner* — Dharti Patel
(74) *Attorney, Agent, or Firm* — Holland & Hart LLP

(57) ABSTRACT

The disclosure relates to a relay having a relay contact, having an electrical connection terminal at which an electrical variable can be tapped off, a control connection for receiving a control signal for opening the relay contact, and a controller. The controller is configured to respond to the reception of the control signal by sensing a change of amplitude of the electrical variable and to open the electrical relay contact with a time delay when a rising amplitude of the electrical variable is sensed, in order to reduce an electrical loading on the relay contact. The controller is further configured to respond to the reception of the control signal by opening in a first disconnection process, to sense the amplitude of the electrical variable, to close the relay contact when the rising amplitude is sensed and to open it again, with a time delay, in a second disconnection process.

14 Claims, 3 Drawing Sheets

RELAY WITH A CONTROLLER

CROSS-REFERENCE TO RELATED APPLICATION

This application claims priority to German patent application No. 10 2016 117 271.5, entitled "Relais mit einer Steuerung", and filed on Sep. 14, 2016 by the Applicant of this application. The entire disclosure of the German application is incorporated herein by reference for all purposes.

BACKGROUND

The present disclosure relates to an electromechanical relay having a controller.

Different types of relays are used in different applications. Typical applications in the industrial sector are the actuation of electrical loads, which may be resistive, inductive or capacitive loads.

Since a relay is an electromechanical component, the relay always exhibits a mechanical behaviour during operation. Hence, when the relay is activated, the relay contacts can momentarily bounce or flutter before the relay contacts ultimately arrive at the final position. Furthermore, there is the risk of large electrical or magnetic fields in the phase of contact bouncing, particularly when a relay contact is closed at the voltage maximum or opened at the current maximum, which can additionally result in the formation of an undesirable arc and of an arc voltage across the open relay contact.

If the arc has a sufficiently high level of energy, the arc can damage the relay contacts in the relay. Furthermore, the arc can weld the contacts to one another as a result of the production of heat.

It is therefore the object of the present disclosure to provide an improved relay.

SUMMARY

This object is achieved by the features of the independent claims. Advantageous examples of the disclosure are the subject matter of the dependent claims, the description and the accompanying figures.

The disclosure is based on the insight that, to prevent a large arc voltage, a relay contact can be opened with a time delay when the current amplitude is rising. In this manner, a peak value of a current through the relay contact or of a voltage across the relay contact in the closed state of the relay contact can be taken up, so that ideally no arc forms or an arc is extinguished. This protects the relay contact from overloading.

In accordance with one aspect, the disclosure relates to a relay having a relay contact, having an electrical connection terminal at which an electrical variable can be tapped off; a control connection for receiving a control signal for opening the relay contact; and a controller that is configured to respond to the reception of the control signal by sensing a change of amplitude of the electrical variable and to open the electrical relay contact with a time delay when a rising amplitude of the electrical variable is sensed, in order to reduce an electrical loading on the relay contact.

The time-delayed opening of the relay contact is preferably effected only when the amplitude of the electrical variable is rising, in order to protect the relay contact against a rising electrical loading in the disconnection process. This also reduces the probability of the occurrence of an arc.

The rising amplitude is connected to a positive change of amplitude, that is to say to a rising edge.

In one example, the controller is configured to open the relay contact after expiry of a predetermined interval of time after the reception of the control signal when the rising amplitude of the electrical variable is sensed.

In one example, the interval of time is dependent on a period duration of the electrical variable, in particular is half a period duration, for example minus a reactionary delay in the relay. In this manner, the disconnection process is moved to the falling edge or a zero crossing of the electrical variable.

In one example, the controller is configured to respond to the reception of the control signal by opening in a first disconnection process, to sense the amplitude of the electrical variable, to close the relay contact when the rising amplitude is sensed and to open it again, with a time delay, in a second disconnection process.

The interim closing of the relay contact takes up the rising of the amplitude of the electrical variable when the relay contact is closed, as a result of which the relay contact is subject to less loading and the formation of an arc is hampered.

In one example, the controller is configured to reopen the relay contact immediately after the closing.

In one example, the controller is configured to sense a falling amplitude or an amplitude zero crossing of the electrical variable and to reopen the relay contact when the falling amplitude or the amplitude zero crossing of the electrical variable is sensed, in order not to take up a peak value of the electrical variable when the relay contact is closed.

In one example, the controller is configured to sense an amplitude zero crossing of the electrical variable and to reclose the relay contact when the amplitude zero crossing of the electrical variable is sensed, in order to take up a peak value of the electrical variable when the relay contact is closed.

In one example, the controller is configured to sense an arc voltage when the relay contact is open, and to close and reopen the relay contact only when the arc voltage is present.

In one example, the controller is configured to close and reopen the open relay contact in a bounce-like manner or briefly, particularly within half a period duration of the electrical variable or within an interval of time of 5 ms, 10 ms or 15 ms.

In one example, the controller is configured to close the open relay contact when the control signal is received or present or contrary to the control signal for opening the relay contact.

In one example, the controller is configured to determine a time for the time-delayed opening of the relay contact, and to open the relay contact at the determined instant with a time delay.

In one example, the controller is configured to determine the instant on the basis of a load behaviour, particularly on the basis of an inductive or capacitive load behaviour, of an electrical load connectable to a load connection of the relay.

In one example, the controller is configured to determine the load behaviour of the electrical load or to read it from a memory.

In one example, the controller is configured to reopen the relay contact with a time delay after expiry of a predetermined interval of time after the sensing of the rising amplitude of the electrical variable.

In one example, the controller is configured to sense a rising edge, particularly a rising sinusoidal or cosinusoidal edge, of the electrical variable, in order to sense the rising amplitude.

In one example, the controller is configured to close the relay contact, or to keep it closed, on the rising edge of the electrical variable and to reopen it, or to open it with a time delay, on a falling edge of the electrical variable, in order to keep the controllable relay contact closed for a peak value of the electrical variable.

In one example, the controller is configured to detect an arc voltage across the open relay contact in a switch-off process of the relay, and to close the controllable relay contact in the switch-off process of the relay when an arc voltage is detected.

In one example, the electrical variable is a current through the relay contact.

In accordance with a second aspect, the disclosure relates to a method for controlling a relay having a controllable relay contact, involving: tapping off an electrical variable at an electrical connection terminal of the relay; receiving a control signal for opening the relay contact; sensing a change of amplitude of the electrical variable when the relay contact is open; and opening the relay contact with a time delay when a rising amplitude of the electrical variable is sensed.

In one example, the method comprises opening the relay contact in response to the reception of the control signal; sensing the change of amplitude of the electrical variable when the relay contact is open; closing the open relay contact (102) when the rising amplitude of the electrical variable is sensed; and opening the relay contact (102) with a time delay when the rising amplitude of the electrical variable is sensed.

The method can, in one example, be performed by means of the relay according to the first aspect of the disclosure.

Further features of the method emerge from the features of the relay according to the first aspect of the disclosure.

BRIEF DESCRIPTION OF THE DRAWINGS

Examples of the present disclosure are explained with reference to the accompanying figures, in which.

DETAILED DESCRIPTION OF THE DRAWINGS

Figure 1:
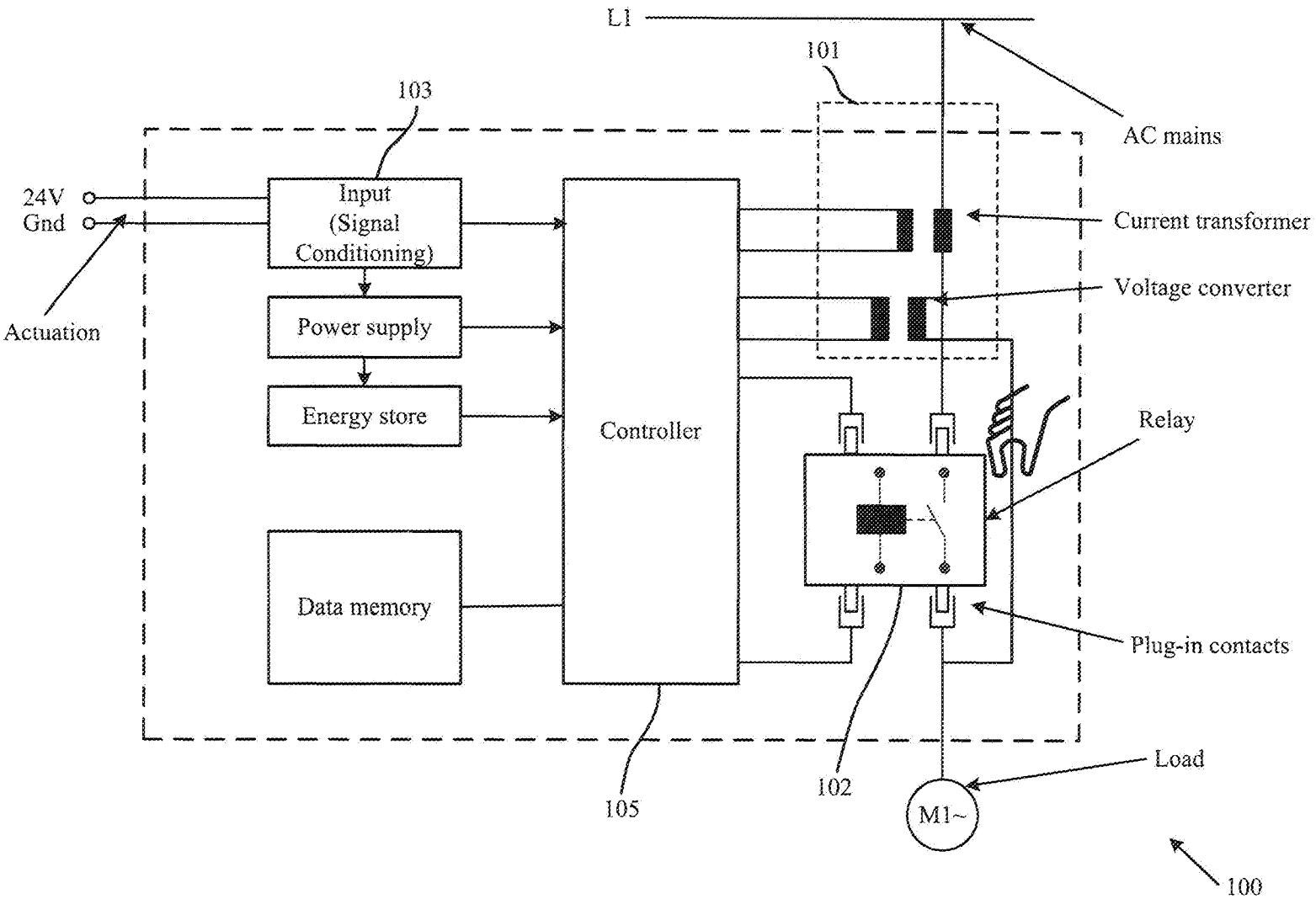
FIG. 1 shows a relay according to one example.

FIG. 1 shows a relay 100 having a controllable relay contact 102, having an electrical connection terminal 101 at which an electrical variable can be tapped off, a control connection 103 for receiving a control signal for operating the relay contact, and a controller 105 that is configured to respond to the reception of the control signal by sensing a change of amplitude of the electrical variable and to open the relay contact with a time delay when a rising amplitude of the electrical variable is sensed.

In one example, the controller 105 is configured to respond to the reception of the control signal by opening the relay contact in a first disconnection process, wherein the controller is configured to sense a change of amplitude of the electrical variable and to close the open electrical relay contact when a rising amplitude of the electrical variable is sensed and to reopen it or open it with a time delay in a second disconnection process.

In the case of smaller relays, e.g. with an overall width of 6 mm, the contact spacings are <0.5 mm from one another. If the moment of switching is presently not at the current zero crossing but rather slightly afterwards on account of tolerances, then the current for the half-cycle cannot be interrupted anymore. The arc is then present for approximately 10 ms at 50 Hz and results in increased thermal loading. Reclosing the relay contact 102 hampers formation of an arc, or an arc burn time is shortened.

By way of example, the arc burning voltage (measured) is 25 V for a switching current of 10 A and a power loss at the relay contact of 250 W.

In one example, the instant of the relay contact 102 being closed again is also dependent on a type of load. The type of load with its specific current characteristic has an influence on contact life. Precise knowledge of the type of a load is therefore advantageous.

The most common types of load are listed below with the relevant IE (inrush current) for IN (continuous current).

1. Resistive load>IE=IN
2. Lamp load>20-40×IN
3. Motor load>6-10×IN
4. Solenoid valves>10-20×IN
5. Capacitors>20-40×IN A few computation examples are given below that illustrate an exemplary loading on the relay contact 102. Closing and reopening the relay contact can advantageously reduce an electrical loading of the relay contact 102 to the level of the loading without an arc.

Example for a loading with an arc:
IN=10 A
Rcontact=5 mOhm
Uarc voltage=20 V
P1=0.5 W
P2=200 W Example for a loading without an arc:
IN=10 A
Rcontact=5 mOhm
Uarc voltage=20V
P1=0.5 W
P2="0"

Forward Power Loss:

$$PFAV = VFO(T\max)IFAV + rF(T\max)IRMS^2$$

Temperature Computation:

$$Tr = Ta + Rth\left[PFAV1\frac{tP1}{T} + PAV2\frac{tP2}{T} + PAV3\frac{tP3}{T}\right]$$

Abbreviations:
Tr=Relay temperature
Ta=Ambient temperature
Rth=Thermal resistance of contact with the surroundings
PFAV 1=Mean forward power loss P1
PFAV 2=Mean forward power loss P2
T=Period duration
tP1=Pulse duration 1
tP2=Pulse duration 2
tP3=Pulse duration 3
VFO=Contact voltage
IFAV=Mean forward current
rF=Resistive component
IRMS=root mean square current The switch-off process or disconnection process in which the relay contact 102 is opened can be achieved with a falling edge of the control signal, for example.

In one example, the arc voltage (arc burning voltage) across the open relay contact is sensed by measurement, for example, as a result of which it is possible for improved contact load reduction to be achieved in the disconnection process of the relay 102.

If, by way of example, the arc voltage and the current rise with a corresponding, for example the same, arithmetic sign, then it is possible for a fresh switch-off instant or a time at which the relay contact 102 is opened again to be determined more precisely.

As the arc voltage across the relay contact 102 increases, an increasing arc forms when the coil of the relay 102 has zero current and after a current zero crossing, i.e. with a rising current amplitude, when the relay contact 102 is opening.

A decreasing arc with a decreasing arc voltage forms when the coil of the relay 102 has zero current, a current zero crossing is imminent and the relay contact 102 is open.

An arc across the relay contact 102 does not form when the coil of the relay 102 has zero current and the current zero crossing takes place at the same time as the relay contact 102 is opened.

If the relay contact 102 is opened after the current zero crossing, i.e. when the current amplitude is rising, then an arc can form up to the subsequent current zero crossing. Closing and reopening the relay contact can hamper the formation of the arc in this case too.

Figure 2A:
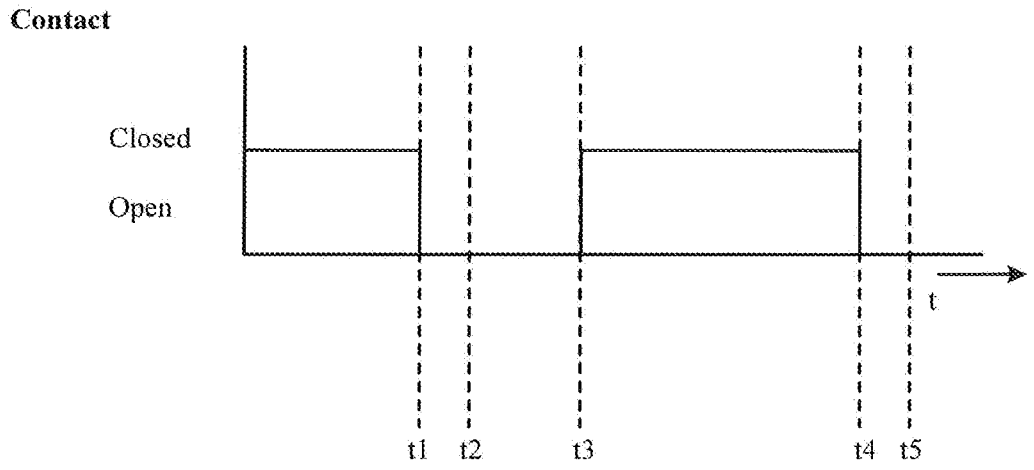
FIG. 2A, B, C show timing diagrams for contact loading.
Figure 2B:
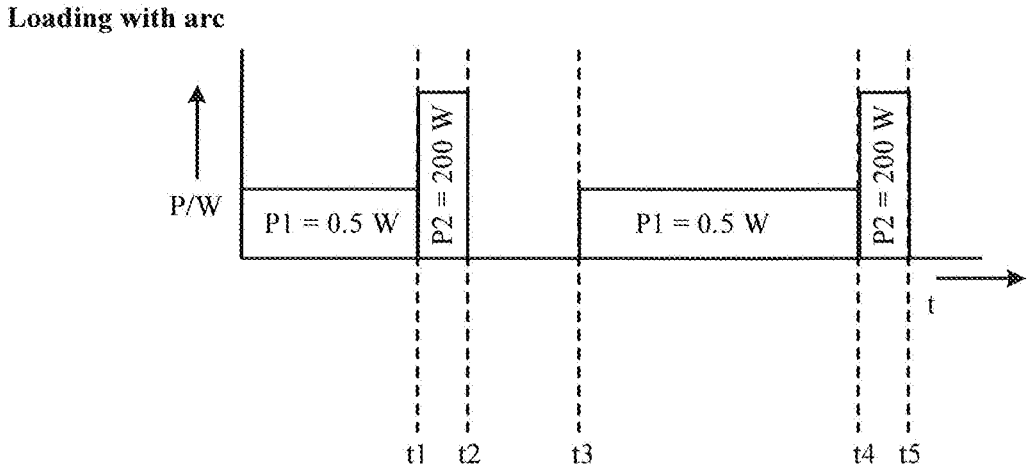
Figure 2C:
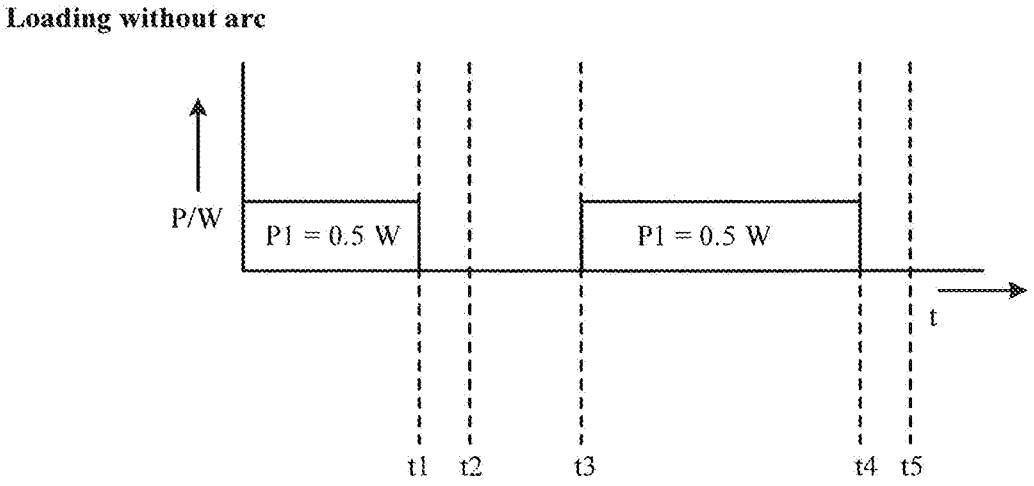

FIGS. 2A, 2B and 2C depict exemplary timing diagrams for the contact loading.

As depicted in FIG. 2A, the switch-off process is concluded at instant t1, so that the relay contact 102 is open. In the subsequent interval of time up to instant t2, an arc can form. In a new interval of time, the relay contact 102 is closed at instant t3, as depicted in FIG. 2B, in which the loading on the relay contact 102 with an arc in the phase t1/t2 or t4/t5 is depicted. If the relay contact 102 is reopened at instant t1 or t4, then an arc can admittedly form for a short period of time, up to instant t2 or t5. However, said arc has a distinctly reduced power, which means that the loading on the relay contact 102 is reduced and is comparable with the loading without an arc depicted in FIG. 2C.

The switching delay conditional upon the closing of the relay contact 102 may be 2 ms, for example, and can be taken into consideration.

In one example, the relay contact 102 is opened by disconnecting a coil of the relay 101, i.e. putting it into a zero-current state.

In one example, after the coil of the relay 101 is disconnected, the relay contact 102 is opened after the current zero crossing, so that a further, inverse, current rise can take place and an arc voltage can be measured. The contact load reduction can then be initiated by the initiation of the reclosing of the relay contact 102. In this case, it is optionally possible for the fresh switch-off instant to be computed. In this case, the current interruption can take place in the subsequent, for example, the directly subsequent, current zero crossing.

An advantage of the closing of the relay contact 102 in the switch-off process is minimization of the arc or of flashes of light. Further, this allows EMC emission to be reduced.

The brief closing of the relay contact 102 reduces the electrical loading thereof in the switch-off process. This also leads to a reduction in the temperature rise at the relay contact 102. A further advantage is the reduction in the current spikes in the switch-off process. Overall, this leads to an increase in the life of the relay 101.

FIGS. 3A to 3D depict exemplary timing diagrams for the contact loading.

Figure 3A:
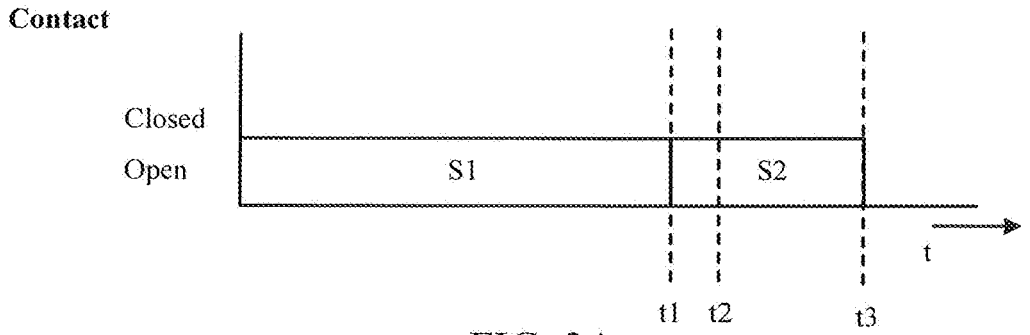
FIG. 3A, B, C, D show timing diagrams for contact loading.
Figure 3B:
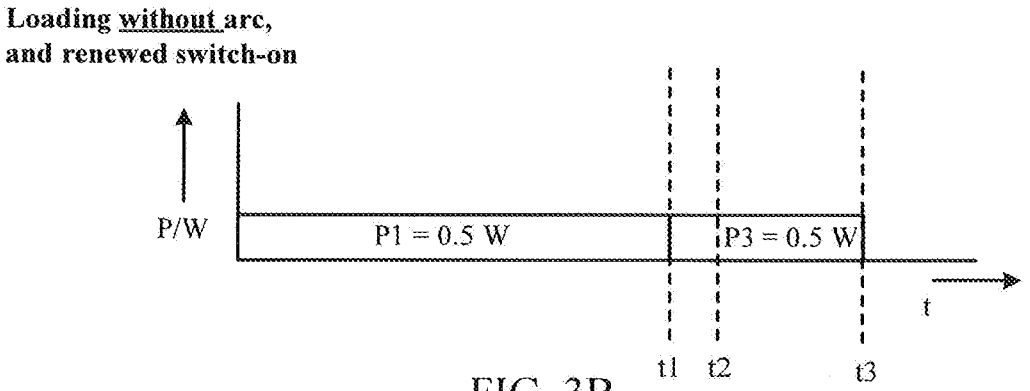

As depicted in FIG. 3A, the switch-off process is initiated in the interval of time S1 up to instant t1, for example by virtue of reception of a control signal for opening the relay contact 102. When a rising current amplitude is sensed, the opening of the relay contact 102 is delayed by the interval of time S2 up to instant t3, at which the current amplitude falls or is at the zero crossing, for example. FIG. 3B depicts the resulting, ideally constant, loading on the relay contact 102 at 0.5 W, for example. This prevents the formation of an arc.

Figure 3C:
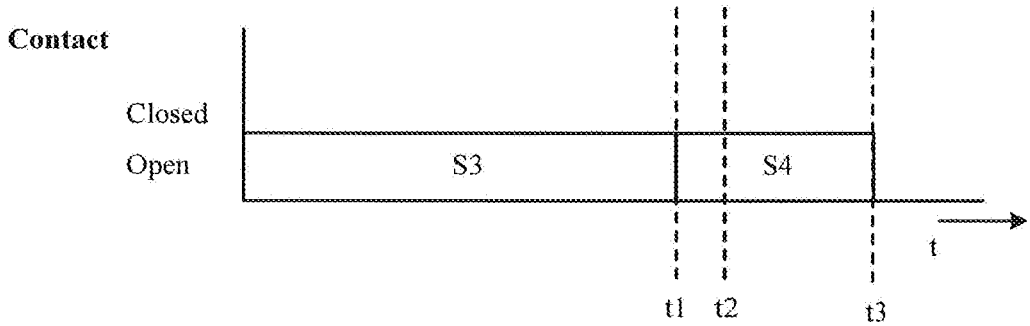
Figure 3D:
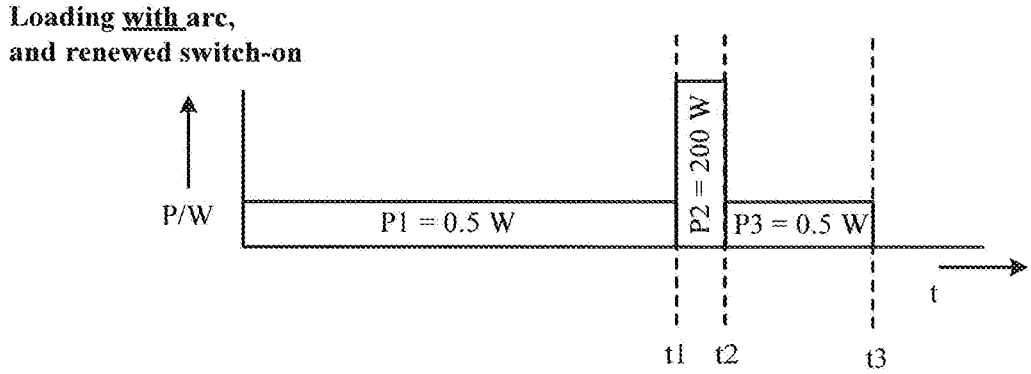

FIG. 3C depicts the case in which the switch-off process is initiated in the interval of time S3 up to instant t1, so that the relay contact 102 is opened at instant t1. If the relay contact 102 is opened when the current amplitude is rising, an arc can form that electrically loads the open relay contact 102, for example with 200 W. Briefly closing the relay contact 102 at instant t2 and reopening the relay contact at instant t3 can reduce the loading on the relay contact 102 in the transitional interval of time S4 to 0.5 W, for example, as depicted in FIG. 3D.

The computation of the switching times of the relay contact 102 can be performed as follows:

| | |
|---|---|
| A + B | Disconnection but switch-off delayed by S2; |
| C + D | Switch-off phase with arc but load reduction by S4 |

where:

A+B t1: the current amplitude has passed through zero and is rising again. The switch-off process (S1) has already been initiated, for example, but the relay contact 102 has not yet been opened at present. In this case, the relay contact 102 is switched on once again (S2) and the switch-off instant t3 is computed again in a shortened manner. At instant t3, due disconnection takes place.

C+D t1: the current amplitude has passed through zero and is rising again. The switch-off process (S3) was initiated too late and the relay contact 102 has opened. In this case, the relay contact 102 is switched on (S4) once again and the switch-off instant t3 is computed again in a shortened manner. At instant t3, due disconnection takes place.

What is claimed is:

1. A relay having a relay contact, comprising:

an electrical connection terminal at which an electrical variable can be tapped off;

a control connection for receiving a control signal for opening the relay contact; and a controller that is configured to respond to the reception of the control signal by sensing a change of amplitude of the electrical variable and to open the electrical relay contact with a time delay when a rising amplitude of the electrical variable is sensed, in order to reduce an electrical loading on the relay contact;

wherein the controller is configured to:

respond to the reception of the control signal by opening the relay contact in a first disconnection process, sense the amplitude of the electrical variable, close the relay contact when the rising amplitude is sensed, and open the relay contact again, with a time delay, in a second disconnection process.

2. The relay according to claim 1, wherein the controller is configured to open the relay contact after expiry of a predetermined interval of time after the reception of the control signal when the rising amplitude of the electrical variable is sensed.

3. The relay according to claim 2, wherein the interval of time is dependent on a period duration of the electrical variable, in particular is half a period duration or half a period duration minus a reactionary delay in the relay.

4. The relay according to claim 1, wherein the controller is configured to sense an amplitude zero crossing of the electrical variable and to reclose the relay contact when the amplitude zero crossing of the electrical variable is sensed, in order to take up a peak value of the electrical variable when the relay contact is closed.

5. The relay according to claim 1, wherein the controller is configured to sense an arc voltage when the relay contact is open, and to close and reopen the relay contact only when the arc voltage is present.

6. The relay according to claim 1, wherein the controller is configured to close and reopen the open relay contact in a bounce-like manner or briefly, particularly within half a period duration of the electrical variable or within an interval of time of 5 ms, 10 ms or 15 ms.

7. The relay according to claim 1, wherein the controller is configured to close the open relay contact when the control signal is received or present or contrary to the control signal for opening the relay contact.

8. The relay according to claim 1, wherein the controller is configured to determine an instant for the time-delayed opening of the relay contact, and to open the relay contact at the determined instant with a time delay.

9. The relay according to claim 8, according to any one of the preceding claims, wherein the controller is configured to determine the instant on the basis of a load behaviour, particularly on the basis of an inductive or capacitive load behaviour, of an electrical load connectable to a load connection of the relay.

10. The relay according to claim 1, wherein the controller is configured to sense a rising edge, particularly a rising sinusoidal or cosinusoidal edge, of the electrical variable, in order to sense the rising amplitude.

11. The relay according to claim 10, wherein the controller is configured to close the relay contact, or to keep it closed, on the rising edge of the electrical variable and to reopen it, or to open it with a time delay, on a falling edge of the electrical variable, in order to keep the controllable relay contact closed for a peak value of the electrical variable.

12. The relay according to claim 1, wherein the controller is configured to detect an arc voltage across the open relay contact in a switch-off process of the relay, and to close the controllable relay contact in the switch-off process of the relay when an arc voltage is detected.

13. The relay according to claim 1, wherein the electrical variable is a current through the relay contact.

14. A method for controlling a relay having a controllable relay contact, comprising:

tapping off an electrical variable at an electrical connection terminal of the relay;

receiving a control signal for opening the relay contact at a control connection of the relay;

sensing a change of amplitude of the electrical variable when the relay contact is not yet open;

opening the relay contact in response to the reception of the control signal;

sensing the change of amplitude of the electrical variable when the relay contact is open;

closing the open relay contact when the rising amplitude of the electrical variable is sensed; and opening the relay contact with a time delay when a falling amplitude of the electrical variable is sensed.

* * * * *